United States Patent [19]

Ogiri et al.

[11] Patent Number: 5,053,817

[45] Date of Patent: Oct. 1, 1991

[54] SUPPORTING AND DRIVING MECHANISM FOR A ROTATING BODY

[75] Inventors: Tadakazu Ogiri; Katsuhide Yamaguchi, both of Takatsuki; Toshiharu Nakai, Ibaraki; Yoshio Morita, Matsubara; Koji Migita, Sakai; Hiroyuki Tanaka, Yamatokoriyama, all of Japan

[73] Assignee: Mita Industrial Co., Ltd., Osaka, Japan

[21] Appl. No.: 593,641

[22] Filed: Oct. 5, 1990

[30] Foreign Application Priority Data

Oct. 31, 1989 [JP] Japan ..... 1-285797

[51] Int. Cl.[5] ..... G03G 15/00

[52] U.S. Cl. ..... 355/211; 74/206; 355/200

[58] Field of Search ..... 355/211, 110, 210, 213, 355/200; 74/202, 205, 206, 209

[56] References Cited

U.S. PATENT DOCUMENTS 3,990,792 11/1976 Kono et al. ..... 74/526

4,444,069 4/1984 Dangschat ..... 74/209

*Primary Examiner*—Joan H. Pendegrass

*Assistant Examiner*—Christopher Horgan

*Attorney, Agent, or Firm*—Beveridge, DeGrandi & Weilacher

[57] ABSTRACT

A supporting and driving mechanism including a rotatable body and a supporting unit for assuring stable support and rotation of the rotatable body for a long time. The mechanism includes an axis member at either end of the rotatable body, a driven gear at one end of the rotatable body, two rollers and a driving gear of the supporting unit. The two rollers are placed parallel to each other and the distance between the closed surfaces of the rollers is smaller than the diameter of the axis member of the rotatable body. The driving gear engages the driven gear and transmits a driving force to the driven gear of the rotatable body. The driving force applied from the driving gear to the driven gear directs between the centers of the two rollers when the driving force is translated so that the origin of the force is brought to the center of the axis member of the rotatable body. Thus the axis member is pressed toward the two rollers while the rotatable body is driven by the supporting unit, whereby the position of the axis member is fixed and the stable rotation of the rotatable body is assured for a long time.

16 Claims, 3 Drawing Sheets

SUPPORTING AND DRIVING MECHANISM FOR A ROTATING BODY

The present invention relates to a mechanism for supporting and driving a rotatable body.

BACKGROUND OF THE INVENTION

A conventional supporting and driving mechanism of a rotatable body is explained with reference to the photoconductive drum of an electrophotographic printing machine (i.e., a plain paper copyer, a laser beam printer, etc.). The drum should be supported at a fixed position and should be rotated in the position stably in an operation. For supporting the drum, the axis of the drum is received by a U-shaped recess of the machine frame. For driving the drum, a gear (driven gear) provided at an end of the drum is engaged with another gear (driving gear) of a driving unit fixed to the machine frame.

A problem of the conventional supporting and driving mechanism is that the support of the drum is unstable when the driving force applied from the driving gear to the driven gear is directed upward even though slightly, i.e., when the driving force has any upward component force, because the drum tends to lift toward the opening of the U-shaped recess. The lift also loosens the engagement of the driving and driven gears which leads to an unstable rotation of the drum. Normally the inner wall of the recess is made of copper-based sintered alloy for the purpose of less friction, less abrasion and more electric conductivity between the drum and the ground, but the long time surface slip between the static recess and the rotating axis causes abrasion both on the recess surface and the axis surface, and the rotation will become hard and unstable.

SUMMARY OF THE INVENTION

An object of the present invention is therefore to provide an improved supporting and driving mechanism for a photoconductive drum of an electrophotographic printing machine that needs stable support and rotation for a long period of time.

Further object of the present invention is to provide, more generally, a supporting and driving mechanism for a rotatable body, not limited to such a drum, also assuring a long time stable support and rotation of the rotatable body.

These and other objects are achieved by a supporting and driving mechanism according to the present invention including a rotatable body and a supporting unit. The mechanism includes: an axis member provided at either end of the rotatable body; a driven gear provided at at least one end of the rotatable body; and two rollers and a driving gear provided in the supporting unit. The two rollers are placed parallel to each other in the supporting unit, and the distance between the closest surfaces of the two rollers is smaller than the diameter of the axis member of the rotatable body. The driving gear is placed in the supporting unit with respect to the two rollers so that the driving force applied from the driving gear to the driven gear is directed between the centers of the two rollers when the driving force is translated so that the origin of the force is brought to the center of the axis of the rotatable body. Thus the axis member is pressed toward the two rollers while the rotatable body is driven by the supporting unit, whereby the position of the axis member (or the rotatable body) is fixed and the stable rotation of the rotatable body is assured for a long time.

DETAILED DESCRIPTION OF THE PREFERRED EMBODIMENT

Figure 1:
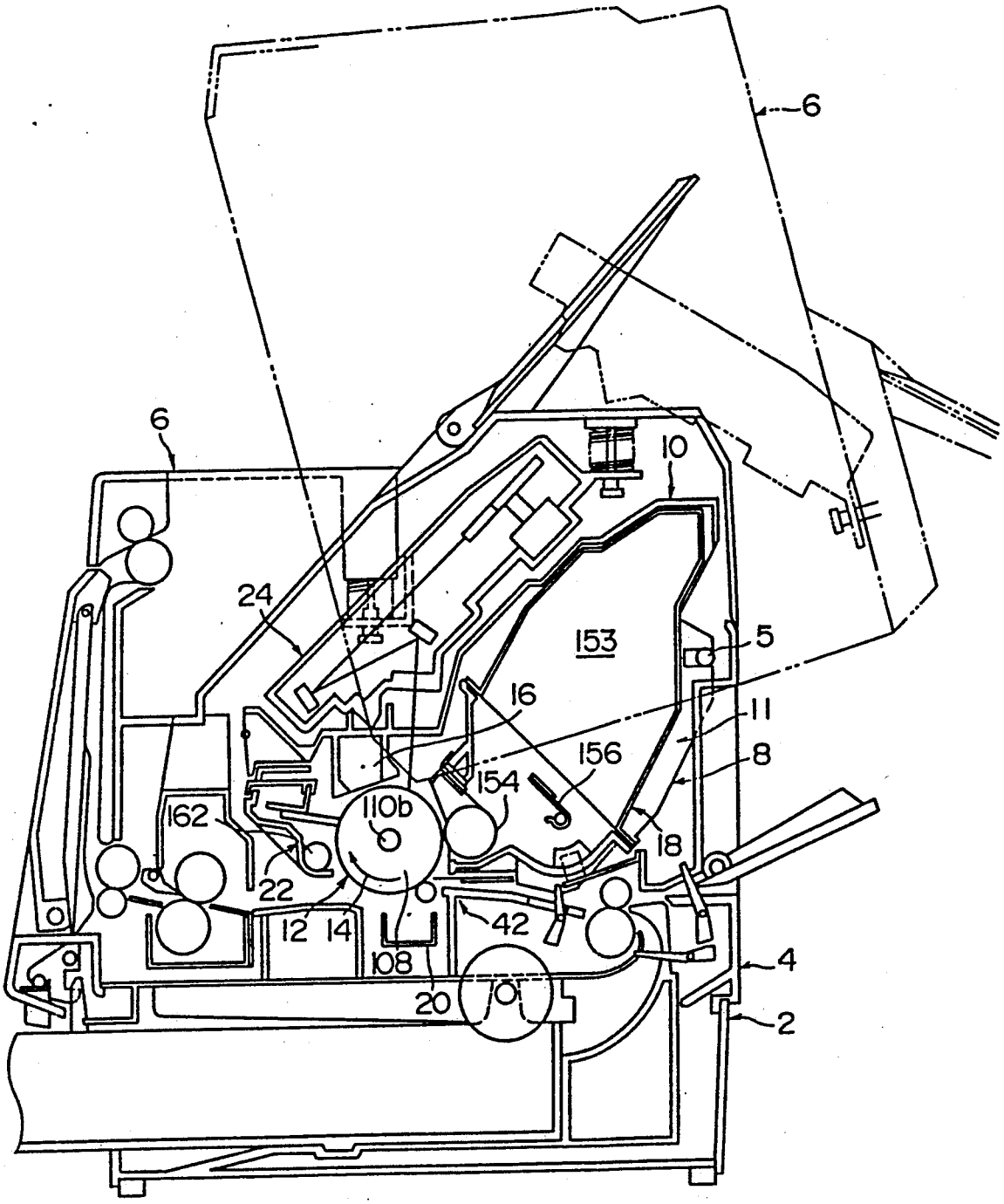
FIG. 1 is an inner side view of a laser beam printer using a supporting and driving mechanism of the present invention.

The present invention is explained in detail here by way of a laser beam printer as shown in FIG. 1 which uses a driving mechanism of the present invention. The laser beam printer has a housing 2 which is composed of a lower housing 4 and an upper housing 6 which can be opened, as shown in FIG. 1, around a pivot 5.

Figure 4:
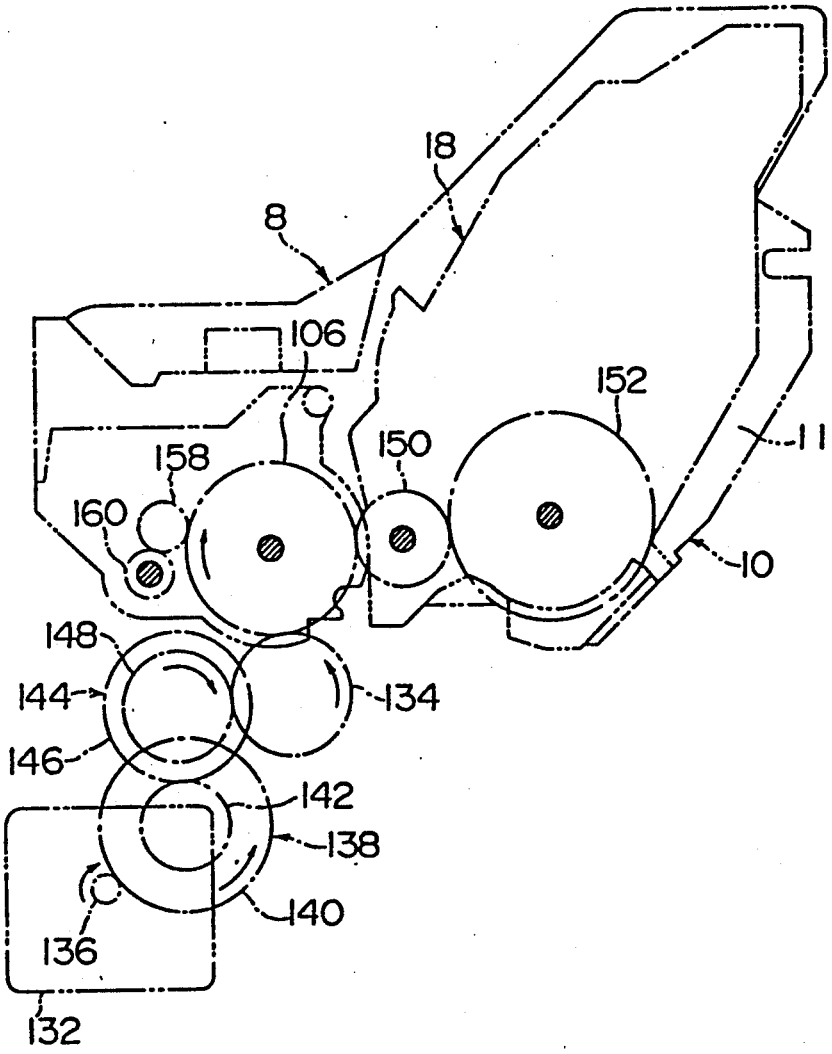
FIG. 4 is a side view illustrating the driving mechanism of the drum and other members of the laser beam printer.

A processing unit 8 is placed within and at about the center of the housing 2. The processing unit 8 (which is also shown in FIG. 4) has a unit frame 10 on which the photoconductive drum 12 of the laser beam printer (which corresponds to the rotatable body of the claims) is rotatably supported. The drum 12 normally rotates as shown by the arrow 14, and there are provided around the drum 12, in the rotating direction 14: a main charging unit 16 including a corona discharger; a developing unit 18; a transferring unit 20 including a corona discharger; and a cleaning unit 22. Among the peripheral units, the main charging unit 16, the developing unit 18 and the cleaning unit 22 are attached to the unit frame 10 of the processing unit 8.

Within the housing 2, an optical unit 24 is placed above the processing unit 8, and a paper conveying mechanism 42 is placed under the processing unit 8.

Figure 2:
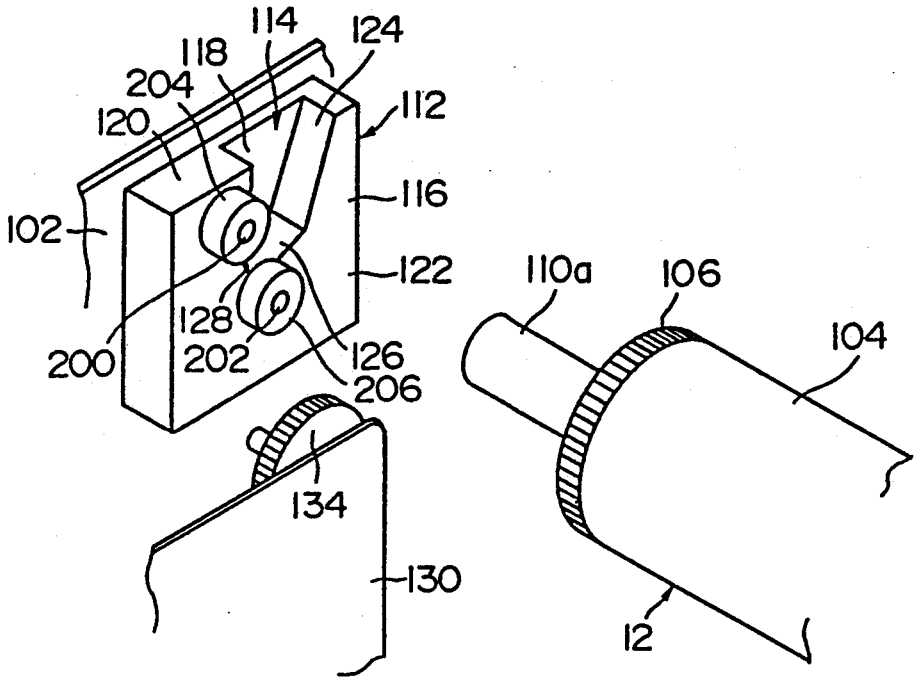
FIG. 2 is a perspective view of unengaged drum, supporting and driving units of the laser beam printer.

Now the supporting and driving mechanism for the drum 12 is detailed referring to FIGS. 1 and 2. The unit frame 10 of the processing unit 8 has a pair of vertical side walls 11 (one is shown in FIG. 1 and none is shown in FIG. 2) between which the drum 12, the developing unit 18 and the cleaning unit 22 are held.

The drum 12 is made of a hollow cylinder 104 with a photoconductive layer covering the cylinder surface. At one end of the cylinder 104 is provided an end gear 106 (which corresponds to the driven gear of the claims) engraved on the cylinder 104. Each end of the hollow cylinder 104 is capped by a circular end plate 108 (one is shown in FIG. 1), and at the center of each end plate 108 is provided an axis (which corresponds to the axis member of the claims; one **110*b* is shown in FIG. 1 and the other 110*a* is shown in FIG. 2**).

The axes **110*a* and 110*b* of the drum 12 are detachably and rotatably supported by respective supporting units 112 fixed on side support walls 102 of the lower housing 4. The supporting unit 112 for supporting the axis 110*a* of the end gear 106 side is detailed in FIG. 2. The supporting unit 112 is made of a block 116 with a slightly slanted U-shaped recess 114 that is open at the upper level 120 and at the side surface 122 of the block 116 while closed to the wall 102 side by an abut plate 118. The slanted U-shaped recess 114 is defined by a plainly sloped side wall 124, a bottom 126 and a curved side wall 128. The plainly sloped side wall 124 facilitates receiving the axis 110a when the drum 12 is set on the supporting units 112. On the side surface 122 of the block 116 horizontally stand two pins 200 and 202: one 200 is near the upper part of the curved side wall 128 and the other is near the lower part of the curved side wall 128. A ball or roller bearing unit 204, 206 (which corresponds to the roller of the claims) is provided on each pin 200, 202. The standing places of the two pins 200, 202 are designed so that the peripheries 204a and 206a (FIG. 3) of the bearing units 204 and 206 slightly surpass the curved surface 128 toward the recess 114, and further the distance between the bearing units 204 and 206 (i.e., the closest distance between the peripheries 204a and 206a) does not exceed the diameter of the axis 110a of the drum 12**.

The other supporting unit for supporting the other axis 110b is constructed same as the supporting unit 112 described above.

A driving unit is mounted on an internal wall 130 (FIG. 2) fixed to the side wall 102 of the lower housing 4. The driving unit includes (FIG. 4): a motor 132; a first gear 136 fixed on the output shaft of the motor 132; a second large gear 140 and third small gear 142 coaxially fixed on a first gear unit 138; a fourth large gear 146 and a fifth small gear 148 coaxially fixed on a second gear unit 144; and a final gear 134 (which corresponds to the driving gear of the claims) for engaging the end gear 106 of the drum 12. As shown by the arrows of FIG. 4, the rotation of the motor 132 is transmitted through the gears 136, 140, 142, 146, 148, 134 and 106 in that order as described above and drives the drum 12.

In the processing unit 8, the driving force given to the drum 12 is also transmitted at one way through the end gear 106, a developer gear 150 and a stirrer gear 152. The developer gear 150 is connected to a magnetic brush roller 154 (FIG. 1) provided within a housing 153 of the developing unit 18, and the stirrer gear 152 is connected to a stirrer 156 for stirring the developer (toner powder) of the laser beam printer contained in the housing 153. The driving force to the drum 12 is further transmitted at another way through the end gear 106 and gears 158 and 160 of the cleaning unit 22. The gear 160 rotates a transferring member 162 which transfers the toner wiped off from the drum 12 to the housing 153 of the developing unit 18.

Now the operation of the driving mechanism is described. When the drum 12 is attached to the unit frame 10 of the processing unit 8, the end gear 106 of the drum 12 engages with the developer gear 150 and the cleaner gear 158. Then when the unit frame 10 is attached to the housing 2 of the printer, the end gear 106 of the drum 12 further engages with the final gear 134 of the driving unit mounted on the inner wall 130.

Figure 3:
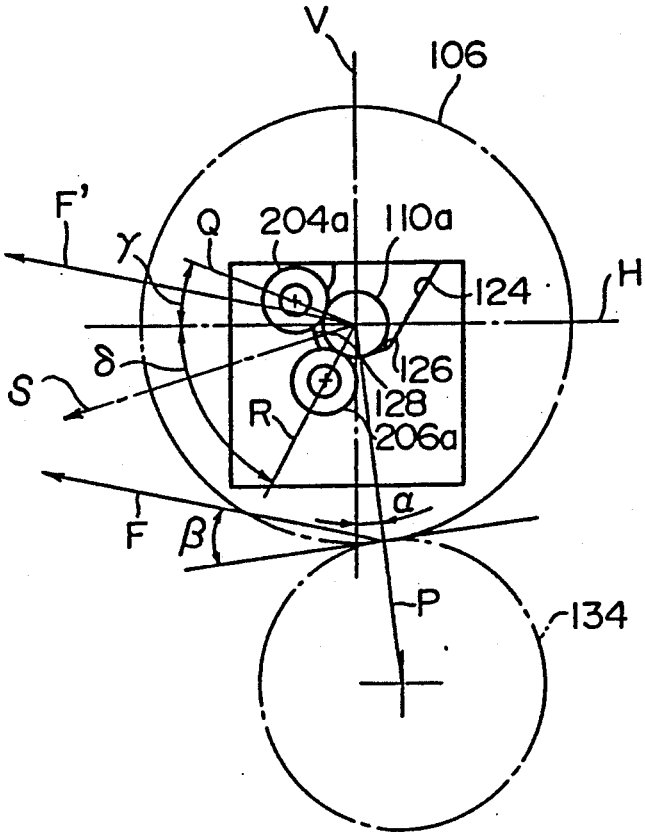
FIG. 3 is a diagram showing the configuration of the drum axis and two bearing units.

The configuration of the supporting and driving mechanism is detailed referring to the kinematic diagram of FIG. 3. The line P connecting the center of the end gear 106 (drum center) and the center of the final gear 134 of the driving unit is inclined counterclockwise by an angle $\alpha$ (6° in the embodiment) from the vertical line V. The line Q connecting the drum center and the center of the upper bearing unit 204 (or the upper pin 200) makes an angle $\gamma$ (20° in the embodiment) with the horizontal line H passing through the drum center, and line R connecting the drum center and the center of the lower bearing unit 206 (or the lower pin 202) makes an angle $-\delta$ ($-60°$ in the embodiment) with the horizontal line H.

Since the rotating force is transmitted through the contacting tooth surfaces of the two engaging gears 134 and 160, the direction of the force F for rotating the end gear 106 is inclined clockwise by the pressure angle $\beta$ of the contacting tooth surface from the common tangent (which is perpendicular to the line P) of the pitch circles of the gears 134 and 106. Thus the rotating force F is inclined clockwise by an angle ($\beta-\alpha$) (in the embodiment, the angle is 14° since the pressure angle $\beta$ of the end gear 106 is 20°) from the horizontal line H. The rotating force F applied to the contacting tooth surface of the end gear 106 is also applied to the axis 110a of the drum 12 in the same direction as a force F'. In this embodiment, as described above, the two pins 200 and 202 (hence the bearing units 204 and 206) are properly arranged so that the direction of the force F' lies within the angle made by the lines Q and R. This geometrical configuration makes the axis 110a of the drum 12 pressed toward the two bearing units 204 and 206, and the axis 110a is assuredly supported by and can freely rotate on the two bearing units 204 and 206. Preferably the force F' directs along the bisector S of the angle made by the lines Q and R in order to equalize the contact pressure on the bearing units 204 and 206. Since the axis 110a rotates solely on the bearing units 204 and 206 (i.e., the axis 110a does not slip on the inner walls 124, 126 and 128 of the recess 114), the surfaces of the axis 110a and of the walls 124, 126 and 128 do not wear, which ensures precise positioning of the drum center and stable rotation of the drum 12 for a long time. When the drum 12 needs an electrical contact with the supporting unit 112, the bearing unit contacts can provide a stable electrical path compared to the case of the contact between a static side wall and a rotating axis in which the contact condition is quite unstable after the contact surface has worn even slightly.

In the above embodiment, the drum 12 is attached to the unit frame 10 and then the unit frame 10 is attached to the housing 2. It is a mere minor modification to change the configuration so that the drum 12 is directly attached to the housing 2, in which case also the end gear 106 of the drum 12 engages the final gear 134 of the driving unit.

Though the invention has been explained with a specific example of the laser beam printer, one can easily understand that the application of the invention is not limited to such a specific machine but any machine having a rotatable body can use the supporting and driving mechanism of the present invention.

What is claimed is:

1. A supporting and driving mechanism including a rotatable body and a supporting unit, the mechanism comprising:

an axis member provided at either end of the rotatable body and the axis member having a circular cross-section;

a driven gear provided at at least one end of the rotatable body;

supporting unit including a receiving surface portion and two rotatable rollers placed parallel to each other so that the distance between the closest surfaces of the rollers is smaller than the diameter of the cross-section of said axis member;

a driving gear provided in the supporting unit for engaging the driven gear; and wherein the axis member of the rotatable body is supported by the receiving surface portion and the two rollers when a driving force of the driving gear is not transmitted to the rotatable body, and the axis member is rotatably supported only by the two rollers upon being pressed toward the two rollers owing to the driving force which develops when the driving force is transmitted to the rotatable body.

2. The supporting and driving mechanism according to claim 1, where each of the two rollers is made of a ball or roller bearing unit.

3. The supporting and driving mechanism according to claim 2, where the rotatable body is a cylindrical body with the driven gear engraved at one end thereof.

4. The supporting and driving mechanism according to claim 3, where the cylindrical body is a photoconductive drum of an electrophotographic printing machine.

5. A supporting and driving mechanism, comprising:

a rotatable body with a circular cross-sectioned axis member at one end, said rotatable body further including a driven gear;

a supporting unit having a wall surface defining a recess which is dimensioned to receive therein the axis member of said rotatable body, and said supporting unit further comprising a pair of rollers each having a peripheral portion extending on opposite sides of said wall surface, and the nearest peripheral surfaces of said two rollers being spaced apart less than the diameter of said axis member; and a driving gear in driving engagement with said driven member, said driving gear having a central axis which is offset to one side of a vertical plane bisecting said axis member, and said rollers having axes about which said rollers rotate which are parallel and which lie on the opposite side of said vertical plane such that, upon operation of said driving gear, the driving force which develops between said driving gear and driven gear biases said axis member into contact with the peripheral surface of said rollers.

6. The supporting and driving mechanism according to claim 5 wherein said axis member extends axial to one side of said driven gear.

7. The supporting and driving mechanism according to claim 5 wherein the driven gear is circular in periphery and the diameter of said axis member is smaller than the diameter of said driven gear.

8. The supporting and driving mechanism according to claim 5 wherein said wall surface includes a curved section past which the peripheries of said rollers extend.

9. The supporting and driving mechanism according to claim 8 wherein said wall surface includes an inclined section defining a side of said recess opposite to said curved section and dimensioned such that said axis member is adapted to slide up or down said inclined section upon insertion and removal of said rotatable body.

10. The supporting and driving mechanism according to claim 5 wherein said rotatable body includes a photoconductive drum of an electrographic printing machine.

11. The supporting and driving mechanism according to claim 5 wherein said rollers are dimensioned and arranged such that the driving force applied from the driving gear to the driven gear is translated so as to be directed between the centers of said two rollers.

12. The supporting and driving mechanism according to claim 11 wherein said two rollers are dimensioned and arranged such that the translated driving force is directed midway between the two rollers.

13. A supporting and driving mechanism, the mechanism comprising:

a rotatable body which includes a photographic drum and an axis member positioned at an end of said rotatable body, said photographic drum and axis member being cylindrical in cross-section and said axis member having a smaller diameter than said photographic drum, said rotatable body further comprising a driven gear;

a driving gear positioned for engagement with said driven member so as to rotate said photographic drum when said driving gear is in operation;

said supporting unit including a receiving surface which defines a recess which is dimensioned to receive said axis member, said supporting unit further comprising two rotatable rollers having parallel axis of rotation and said rollers being spaced such that the distance between the closest surfaces of said rollers is smaller than the diameter of the cross-section of said axis member, and said rollers being dimensioned and arranged such that, upon operation of said driving gear, the forces which develop between said driving gear and driven gear bias said axis member into contact with the surfaces of said rollers.

14. A supporting and driving mechanism according to claim 13 wherein said driven gear is positioned at one end of said photographic drum and said axis member extends axially away from the end of said photographic drum having said driven gear.

15. A supporting and driving mechanism according to claim 14 further comprising a second axis member positioned at the opposite end of said rotatable body and a second supporting unit which receives in supporting fashion said second axis member.

16. A supporting and driving mechanism according to claim 15 wherein said second supporting unit includes a pair of rollers which are spaced such that the distance between the closest surfaces of said rollers is smaller than the diameter of a cross-section of said second axis member, and said pair of rollers being dimensioned and arranged such that, upon operation of said driving gear, the forces which develop between said driving gear and driven gear bias said axis member into contact with the surfaces of said pair of rollers.

* * * * *